US005302415A

United States Patent [19]

Gabara et al.

[11] Patent Number: 5,302,415

[45] Date of Patent: Apr. 12, 1994

[54] ELECTROLESS PLATED ARAMID SURFACES AND A PROCESS FOR MAKING SUCH SURFACES

[75] Inventors: Vlodek Gabara, Richmond, Va.; Che-Hsiung Hsu, Wilmington; Edward W. Tokarsky, Newark, both of Del.

[73] Assignee: E. I. Du Pont de Nemours and Company, Wilmington, Del.

[21] Appl. No.: 987,898

[22] Filed: Dec. 8, 1992

[51] Int. Cl.[5] ..... B05D 1/00

[52] U.S. Cl. ..... 427/306; 427/443.1

[58] Field of Search ..... 427/437, 438, 443.1, 427/306

[56] References Cited

U.S. PATENT DOCUMENTS

| | | | |
|---|---|---|---|
| 3,094,511 | 6/1963 | Hill | 528/337 |
| 3,354,127 | 11/1967 | Hill | 528/339 |
| 3,620,804 | 11/1971 | Bauer | 427/306 |
| 3,673,143 | 6/1972 | Bair | 524/211 |
| 3,686,017 | 8/1972 | Merikheim et al. | 427/304 |
| 3,733,213 | 5/1973 | Jacob | 427/438 |
| 3,819,587 | 6/1974 | Kwoleck | 264/210.8 |
| 3,869,429 | 3/1975 | Blades | 264/203 |
| 4,172,938 | 10/1979 | Mera | 528/341 |
| 4,192,686 | 3/1980 | Soltys | 427/443.1 |
| 4,308,374 | 12/1981 | Vollbracht | 528/336 |
| 4,415,406 | 11/1983 | Wiggins | 427/306 |
| 4,550,036 | 10/1985 | Ludwig | 427/437 |
| 4,552,787 | 11/1985 | Chebiniak | 427/438 |
| 4,634,805 | 1/1987 | Orban | 174/128 R |
| 4,698,414 | 10/1987 | Bair | 528/339 |
| 4,940,608 | 7/1990 | Kawagishi | 427/306 |
| 4,985,046 | 1/1991 | Hartzler | 8/654 |
| 5,024,858 | 6/1991 | Burch | 427/306 |
| 5,143,592 | 9/1992 | Toro | 427/306 |
| 5,160,600 | 11/1992 | Patel | 427/306 |

FOREIGN PATENT DOCUMENTS

| | | |
|---|---|---|
| 1081072 | 12/1954 | Fed. Rep. of Germany . |
| 1235002 | 5/1960 | Fed. Rep. of Germany . |
| 2820502A1 | 11/1979 | Fed. Rep. of Germany . |
| WO90/00634 | 1/1990 | PCT Int'l Appl. . |

*Primary Examiner*—Shrive Beck
*Assistant Examiner*—Vi Duong Dang

[57] ABSTRACT

A process is disclosed for making metal plated PPD-T fibers wherein the plating is durable and highly conductive. The process involves contacting the fibers with an 80 to 90% sulfuric acid solution, neutralizing and washing the fibers with water, and then plating the fibers by an electroless plating process. The acid treatment of the fibers promotes adhesion between the metal and the fiber and high electrical conductivity for the plated metal.

11 Claims, 3 Drawing Sheets

ELECTROLESS PLATED ARAMID SURFACES AND A PROCESS FOR MAKING SUCH SURFACES

BACKGROUND OF THE INVENTION

1. Field of the Invention

This invention relates to electroless metal plating of aramid fibers wherein the metal is strongly adhered to the aramid fiber substrate and provides a highly conductive surface. The aramid is subjected to a preplating treatment including carefully controlled exposure to a concentrated sulfuric acid solution, followed by washing, catalyzation, and the electroless plating, itself.

2. Description of the Prior Art

Electroless plating is the deposition of a metal film by interaction of metal ions and a chemical reducing agent in a basic solution. Electroless plating, in a general way, is well known. One of the difficulties in achieving successful electroless plating has resided in obtaining good adhesion between the plating substrate and the plated metal. While mere encapsulation may suffice for some applications and some articles, good adhesion of the plated metal is essential for fiber surfaces because the plated metal coating must be durable enough to withstand the forces of further processing and end use stresses.

SUMMARY OF THE INVENTION

The present invention provides a process for plating aramid fibers of increased plating rates with a durable metal coating comprising the steps of; contacting aramid fibers in an 80 to 90 % sulfuric acid solution for at least 2 seconds at a temperature in the range from 10° to 50° C., neutralizing and washing the acid-soaked fibers with water until substantially all of the acid is removed, and plating the fibers by an electroless plating process.

For plating the fibers with copper, the electroless plating process is conducted by contacting the acid-treated and washed fibers with a tin-palladium sensitizing solution, rinsing the fibers in water to remove nonadherent sensitizing solution, optionally, immersing the rinsed fibers in an aqueous accelerator solution of mineral acid to remove excess tin ions, and then immersing the fibers in an electroless copper plating bath.

For plating the fibers with silver, the electroless plating process is conducted by contacting the acid-treated and washed fibers with a stannous ion sensitizing solution, rinsing the fibers in water to remove nonadherent stannous ions, immersing the rinsed fibers in an aqueous solution of silver cations to be reduced by the stannous to silver metal for activating the polymer surface, followed by adding a reducing agent to the aqueous solution of silver cations to promote preferential deposition of silver on the silver-activated surface.

In practice of the present invention, it is preferred that the activating metal for copper or nickel plating is palladium; and, for silver, the activator is silver, itself. The preferred aramid is poly(para-phenylene terephthalamide).

DETAILED DESCRIPTION OF THE INVENTION

Figure 1:
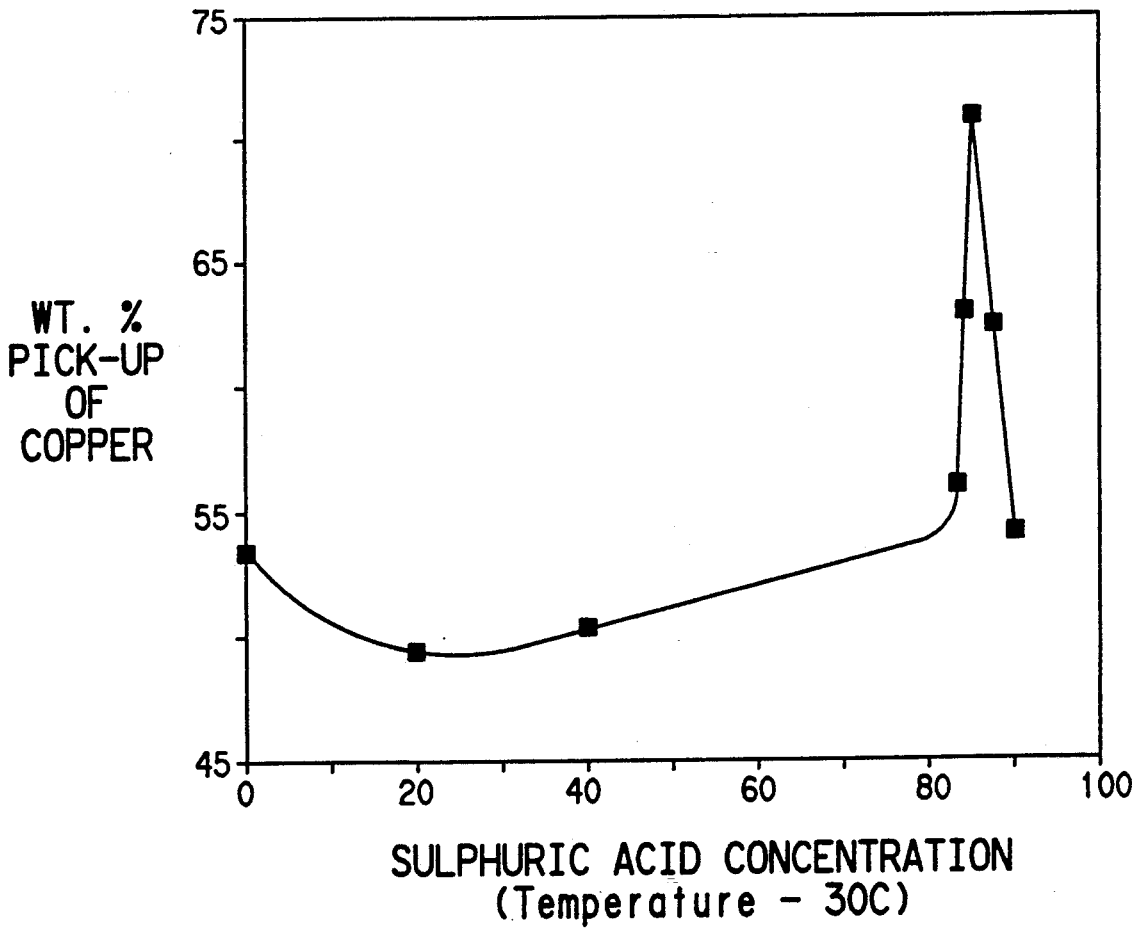
FIG. 1 is a graphical representation of plated copper metal pick-up as a function of sulfuric acid concentration in the fiber acid-treatment.

There has long been a need for conductive aramid fibers which have durable metallic coatings; and that need is especially acute for fibers which exhibit high strength and modulus.

Fibers of aramids have been difficult to plate with a durable metal coating. Aramid fiber surface treatments and pretreatments have, generally, up to now, not been entirely satisfactory.

This invention provides a process for electrolessly plating fibers of aramids at substantially increased plating rates and in a way that yields a plated fiber product of substantially maintained strength and modulus and a metal coating which is highly conductive and strongly adherent. The process can be conducted on a continuous basis or batch-wise.

By "aramid" is meant a polyamide wherein at least 85% of the amide (—CO—NH—) linkages are attached directly to two aromatic rings. Suitable aramid fibers are described in Man-Made Fibers—Science and Technology, Volume 2, Section titled Fiber-Forming Aromatic Polyamides, page 297, W. Black et al., Interscience Publishers, 1968. Aramid fibers are, also, disclosed in U.S. Pat. Nos. 4,172,938; 3,869,429; 3,819,587; 3,673,143; 3,354,127; and 3,094,511.

Additives can be used with the aramid and it has been found that up to as much as 10 percent, by weight, of other polymeric material can be blended with the aramid or that copolymers can be used having as much as 10 percent of other diamine substituted for the diamine of the aramid or as much as 10 percent of other diacid chloride substituted for the diacid chloride or the aramid. As a special case, it has been found that up to as much as 30 percent, by weight, of polyvinyl pyrrolidone can be included with poly(p-phenylene terephthalamide) in aramid fibers to be plated by the process of this invention.

Para-aramids are the primary polymers in fibers of this invention and poly(p-phenylene terephthalamide)(PPD-T) is the preferred para-aramid. By PPD-T is meant the homopolymer resulting from mole-for-mole polymerization of p-phenylene diamine and terephthaloyl chloride and, also, copolymers resulting from incorporation of small amounts of other diamines with the p-phenylene diamine and of small amounts of other diacid chlorides with the terephthaloyl chloride. As a general rule, other diamines and other diacid chlorides can be used in amounts up to as much as about 10 mole percent of the p-phenylene diamine or the terephthaloyl chloride, or perhaps slightly higher, provided only that the other diamines and diacid chlorides have no reactive groups which interfere with the polymerization reaction. PPD-T, also, means copolymers resulting from incorporation of other aromatic diamines and other aromatic diacid chlorides such as, for example, 2,6-naphthaloyl chloride or chloro- or dichloroterephthaloyl chloride; provided, only that the other aromatic diamines and aromatic diacid chlorides be present in amounts which permit preparation of anisotropic spin dopes. Preparation of PPD-T is described in U.S. Pat. Nos. 3,869,429; 4,308,374; and 4,698,414.

Meta-aramids are, also, important for use in the fibers of this invention and poly(m-phenylene isophthalamide)

(MPD-I) is the preferred meta-aramid. By MPD-I is meant the homopolymer resulting from mole-for-mole polymerization of m-phenylene diamine and isophthaloyl chloride and, also, copolymers resulting from incorporation of small amount of other diamines with the m-phenylene diamine and of small amounts of other diacid chlorides with the isophthaloyl chloride. As a general rule, other diamines and other diacid chlorides can be used in amounts up to as much as about 10 mole percent of the m-phenylene diamine or the isophthaloyl chloride, or perhaps slightly higher, provided only that the other diamines and diacid chlorides have no reactive groups which interfere with the polymerization reaction MPD-I, also, means copolymers resulting from incorporation of other aromatic diamines and other aromatic diacid chlorides, provided, only that the other aromatic diamines and aromatic diacid chlorides be present in amounts which do not interfere with the desired performance characteristics of the aramid.

Aramid fibers made by wet or air-gap spinning processes of the previously-mentioned patents are coagulated into a so-called "never-dried" form wherein the fiber includes considerably more than 75 weight percent water. Because never-dried fibers shrink extensively during loss of the water, a strongly adherent metal coating can be plated onto the fibers only after the fibers have been dried to less than about 20 weight percent water in order to collapse the polymer structure of the fiber. Never-dried fibers cannot successfully be plated by the process of this invention due to the shrinkage of fibers as they are subsequently dried. Fibers eligible for use in the process of the present invention are dried fibers having a moisture content of less than 20 weight percent. Generally the fibers used in the process of the present invention will be relatively dry, having a moisture content of about 3.5 to 7% water.

As a first step in the process of this invention, the aramid fibers to be plated are contacted with sulfuric acid at a concentration of 80 to 90%. At sulfuric acid concentrations above 90%, the solvating power of the acid is too high, causing damage to the fibers. At sulfuric acid concentrations below 80%, the treatment time is excessively lengthened and no longer practical. Referring to FIG. 1, it can be seen that a sulfuric acid concentration of 80–90% is critically important to achieve the rapid metal pick-up rate of this invention. While the reason for such pick-up increase is not completely understood, it is clear that treatment with sulfuric acid at concentrations from 80–90% at a temperature of 30 C results in metal pick-up by aramid fibers which is dramatically increased. From FIG. 1, it can be seen that sulfuric acid in the narrow concentration range of about 84–88% is especially preferred for practice of this invention.

The temperature of the sulfuric acid bath should be in the range from 10° to 100° C. and preferably about 20° C. to 40° C. The upper temperature limit is governed by the adverse effect on fiber tensile properties and filament fusion while the lower temperature limit is a matter of practicality;—lower temperatures requiring unacceptably long times for adequate treatment.

The fibers, which can be of any desired thickness, are contacted with the acid solution for at least 2 seconds. With shorter exposure times it is difficult, ultimately, to achieve satisfactory depth of treatment. Longer exposure sometimes produces excessive cracking of the filaments and causes partial loss of tensile properties. As a general rule, soaking fibers in the acid for more than 60 seconds, even at moderate temperatures, results in degradation of the fibers. The preferred contact time is about 15–30 seconds. Exposure time to the acid can be reduced by increasing the temperature and/or increasing the acid concentration. Effective practice of the process of this invention requires a reasonable combination of acid concentration, temperature and soaking time.

Figure 2:
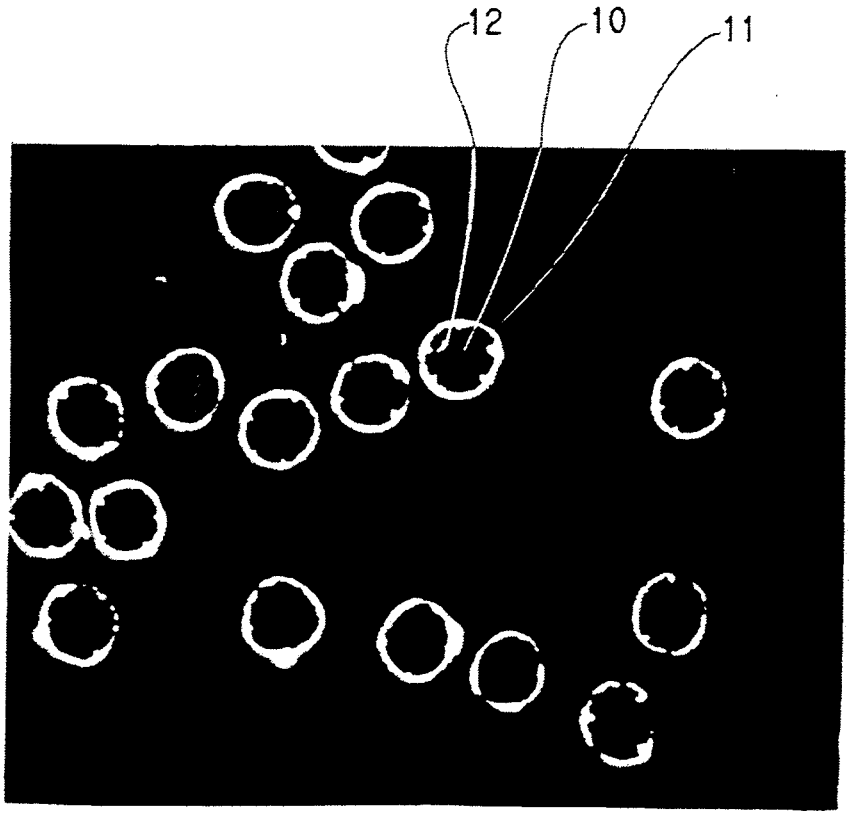
FIG. 2 is a photomicrograph of enlarged cross-sections of the copper plated fibers of this invention.
Figure 3:
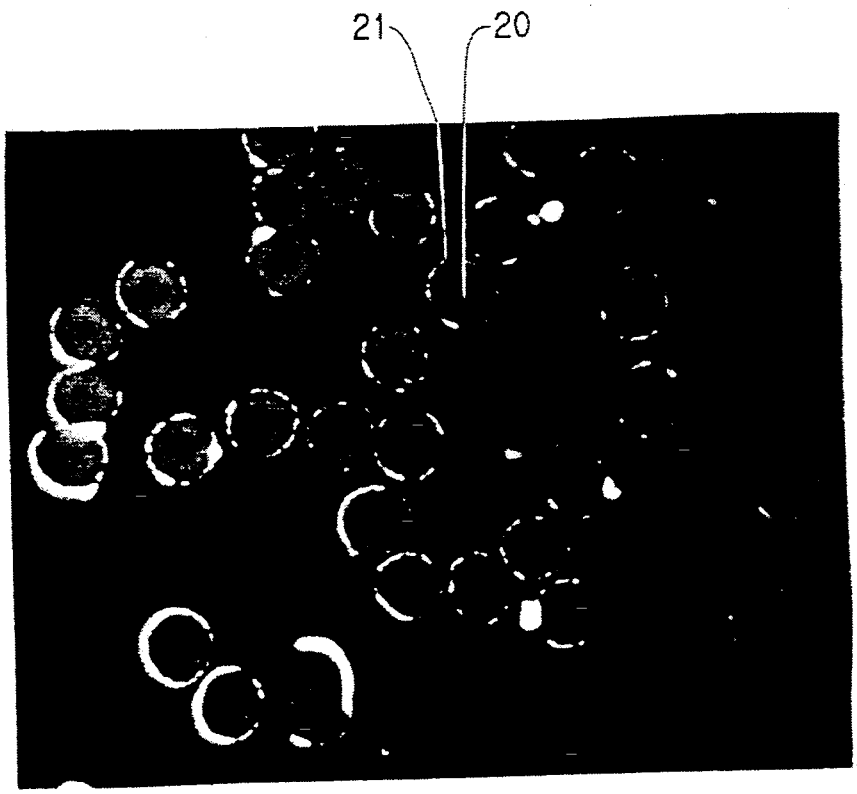
FIG. 3 is a photomicrograph of enlarged cross-sections of copper plated fibers not treated by the process of this invention.

The acid contacting step of the process of this invention causes microscopic cracks and/or other irregularities, such as morphological changes, to be formed through the fiber surface. FIGS. 2 and 3 are photographs of cross sections of PPD-T fibers. FIG. 2 shows cross sections of PPD-T fibers which have been electrolessly plated with copper in accordance with the present invention using the acid soaking treatment and FIG. 3 shows cross sections of PPD-T fibers electrolessly plated without the acid contacting treatment. Referring to FIG. 2, fibers 10 shown in cross section at a magnification of 600×. Metal coating 11 is shown to be heavy, consistent, and continuous around each fiber 10. Most fibers 10 have at least one notch-like groove 12 as a result of the acid treatment of this invention. Referring to FIG. 3, fibers 20 are shown in cross section at a magnification of 600×. Metal coating 21 is shown to be thin and discontinuous.

The acid contacting PPD-T fibers are washed well with water to remove substantially all of the sulfuric acid. Optionally, the fiber can be neutralized with a base such as sodium bicarbonate solution which can be added to the wash water or used in a separate step. It is, also, possible to dry the acid-treated fibers prior to the plating step.

The kernel of this invention resides in the discovery that aramid fibers treated with acid as prescribed herein, can yield an improved metal-plated fiber product. As a general rule, well-known electroless metal plating process can be used to plate the aramid fibers after acid treatment in accordance with the present invention.

For an example of a copper plating process, an aqueous sensitizing solution, sometimes known as an activation bath is prepared using palladium and tin cations as activation catalyst. The acid-contacted and washed PPD-T fibers to be plated are immersed in the bath and agitated to promote activation of the fiber surfaces. The fibers are, then, removed from the activation bath and rinsed and may, if desired, be transferred to an accelerator bath of dilute mineral acid.

The fibers are then placed in, or conducted through, a plating bath with copper ions and formaldehyde wherein the copper ions are complexed to maintain solution, for example, with tetrasodium salt of ethylenediamine tetraacetic acid (EDTA).

Baths having a wide range of metal concentrations can be used in practice of this invention. The preferred plating baths are from about 1 to 5 grams per liter of copper. In tests described herein, baths of 15 to 3 grams per liter of copper are most preferred.

The plating bath, with immersed activated fibers, is moderately agitated for 10 to 20 minutes to assure adequate pick-up. Formaldehyde, pH-adjusting caustic solution, and copper ion solution are added at the rate of depletion. Additions can be made continuously or intermittently. The plated material can then be rinsed and dried. Instead of formaldehyde, other materials can be used as reducing agents. Among the eligible reducing agents are hypophosphite, hydrazine, boron hydride, and the like.

All of the above steps can be conducted with the various baths at temperatures of 10° to 60° C., and preferably 20°-40° C.

For an example of a silver plating process, the acid-contacted fibers are first immersed in an aqueous sensitizing solution, sometimes known as a reducing agent solution such as $SnCl_2/HCl$. The $SnCl_2$-immersed fibers are rinsed with water extensively to remove excess stannous ions and are then transferred to an aqueous bath to which is added a metal complex solution of silver nitrate and ammonia at a bath pH of 8-9.5. During immersion in the metal complex bath, the bath is agitated to ensure that imbibed stannous ions reduce silver ions to silver metal on the polymer surface. Formaldehyde is added to the metal complex solution as a reducing agent and silver ions preferentially deposit on the silver-activated polymer surface. In a typical process, the molar ratio of formaldehyde/silver is from 1.1/1 to 2/1. The amount of silver nitrate is adjusted to provide the desired weight of reduced silver as a function of the fiber material to be plated. The silver-plated fibers are rinsed and dried.

For the purposes of discussing this invention, the activation solution of tin-palladium for copper plating and the reducing solution of stannous ion for silver plating shall be known as sensitizing solutions. The sensitizing solutions are used in electroless plating to promote preferential metal deposition onto the desired surfaces.

Instead of silver or copper, nickel or cobalt or the like can be, also, plated on the acid-contacted fibers with a proper combination of sensitizing solution, reducing agent solution, and metal plating solution.

The plating processes can be conducted on acid-contacted fibers which have been dried or which remain wet from the acid-contacting step. In the case of copper plating, the plating quality appears to be relatively unaffected by drying the fibers after acid contact. However, the silver plating process appears to yield plated silver of the lowest resistance when the fibers, first, are dried at about 15°-80° C., preferably at 15°-20° C. When the fibers to be silver plated are dried at moderate temperature, there appears to be less silver metal impregnated into the fiber structure, as happens with undried fibers, and there appeared to be better continuity of silver coating than is realized with fibers dried at higher temperatures.

TEST METHODS

Thermal Cycling Electrical Resistance

The electrical resistance of a metal coating can be taken to represent a measure of the degree of continuity of the coating; and the degree of change in the resistance after thermal cycling can be taken to represent the degree of metal coating durability.

To determine thermal cycling electrical resistance of a metal coating, plated yarns are cut to 4.5" lengths and mounted in a special continuity fixture for electrical resistance measurements during thermal cycling. The fixture is designed so that all samples can be cycled and resistance monitored simultaneously. The cycling device consists of two separate chambers maintained at −65° C. and 150° C., respectively. The fixture containing the samples is mechanically cycled between the temperature chambers every 15 minutes. Environment in the chambers is air. Resistance is recorded just prior to each temperature change. Resistances are measured with a digital volt meter. Cable resistance is subtracted out of the measurement to give more accurate values. The test and the test apparatus is in accordance with MIL-STD-883C, Method 1010, Condition C.

Data reported in the following examples show the resistances on the hot and cold ends separately. While the raw data were recorded in ohms/4.5", the tables report this same information in terms of ohms/ft. of yarn length.

DESCRIPTION OF THE PREFERRED EMBODIMENTS

In the examples which follow, all parts are by weight unless specifically stated to be otherwise. Also, all samples were wound on open racks for immersion in the various treatment solutions.

EXAMPLE 1

In this example p-aramid yarns were acid treated with a variety of sulfuric acid concentrations to demonstrate the criticality of the acid concentration in the plating process of this invention.

Samples of poly(p-phenylene terephthalamide) yarn of 380 denier having 267 filaments were initially subjected to 3 minutes immersion, at 25° C. with agitation, in a basic fiber cleaning-surfactant solution. The yarns were then rinsed and dried.

Subsequently, samples to be treated according to the present invention were contacted with an 85% sulfuric acid solution held at 30° C. for 15-30 seconds, and were then rinsed several times with water. Controls were run without the acid treatment step.

Each of the yarn samples was then conducted through a copper electroless plating process using commercially available chemistries as follows:

(a) immersing the yarns for about 3 minutes at about 25° C. in an aqueous tin or sodium chloride predip solution, for example, a solution of about 21 percent aqueous Shipley Co. Cataprep® 404 sold by Shipley Co., 2300 Washington St., Newton, Mass., USA;

(b) contacting the yarns for about 3 minutes at about 40° C. with an aqueous sensitizing solution of mineral acid, stannous chloride, and palladium, for example, a solution of 2.6 volume percent Shipley Co. Cataposit® 44 and an aqueous tin or sodium chloride solution, for example, a solution of about 23 percent Shipley Co. Cataprep® 404 to provide a palladium-tin complex for activating the fiber surfaces;

(c) rinsing the yarns for about 3 minutes in flowing water at about 25° C.;

(d) immersing the yarns for about 5 minutes in an aqueous, weakly oxidizing, solution, for example, a solution of about 10 grams per liter of MacDerimid MaCuPrep® 97A Accelerator and about 10 ml per liter of MacDerimid MaCuPrep® 97B Oxidant sold by MacDerimid, Inc., 2444445 Freight St., Waterbury, Conn. 06720 at 25° C. to eliminate tin from the palladium-tin complex for the plating reaction;

(e) rinsing the yarns for about 3 minutes in flowing water at about 25° C.;

(f) immersing the yarns in an aqueous plating bath at about 40°-45° C. containing, for example, 1.50 volume percent Shipley Co. Circuposit® 3350M, 5.2 volume percent Shipley Co. Circuposit®

3350A, and 1.25 volume percent Shipley Co. Circuposit ® 3350B;

(g) rinsing the yarns for about 3 minutes in flowing water at about 25° C.; and (h) drying the yarns for about 30 minutes in air at about 115° C.

Of the above steps, step (a), immersion in the predip, is optional and is used to increase catalyst bath life.

For the purpose of this example, the fibers were analyzed for plated copper metal to determine the amount of copper picked up during the plating process. Copper pick-up, expressed as weight percent of the plated fiber, is shown in Table 1 and, graphically, in FIG. 1. Metal pick-up on the fibers is seen to be remarkably improved for fibers subjected to a treatment using sulfuric acid in the 80–90% concentration range.

Referring to FIG. 1, there is a graph showing the relationship between weight percent pickup of copper on the plated fibers and sulfuric acid concentration for the acid treatment step of the plating process of this invention. Points shown on the graph represent the average of 15 and 30 second acid treatments.

TABLE 1

| Item | Acid Conc. (%) | Treatment Time (Sec.) | Copper Pick-up (wt. %) |
|---|---|---|---|
| Control | 0 | — | 53.34 |
| 1-1 | 20 | 15 | 49.88 |
| 1-2 | 20 | 30 | 48.43 |
| 1-3 | 50 | 15 | 49.47 |
| 1-4 | 50 | 30 | 51.32 |
| 1-5 | 84 | 15 | 53.94 |
| 1-6 | 84 | 30 | 58.51 |
| 1-7 | 85 | 15 | 59.61 |
| 1-8 | 85 | 30 | 66.82 |
| 1-9 | 86 | 15 | 69.89 |
| 1-10 | 86 | 30 | 72.00 |
| 1-11 | 88 | 15 | 60.82 |
| 1-12 | 88 | 30 | 64.86 |
| 1-13 | 90 | 15 | 53.13 |
| 1-14 | 90 | 30 | 55.14 |

EXAMPLE 2

In this example, yarns from a variety of aramids were plated and the durability of the plating was tested. Yarns were plated using the acid treatment process of this invention and comparisons were made by plating yarns without the acid treatment.

The acid treating process and the plating process were the same as were used in Example 1 with the exception that one-third of the amount of sensitizing solution was used. The aramid yarns were as follows:

1. Poly(p-phenylene terephthalamide) in a yarn of 380 denier having 267 filaments;
2. Combination of poly(p-phenylene terephthalamide) and 12 weight percent polyvinyl pyrrolidone in a yarn of 380 denier having 267 filaments;
3. Copolymer of p-phenylenediamine (25 mole %), 3,4'-diaminodiphenylether (25 mole %), and terephthaloyl chloride (50 mole %) in a yarn of about 1000 denier; and
4 Poly(m-phenylene isophthalamide) in a yarn of 400 denier having 267 filaments.

Each of the plated yarns was subjected to the Thermal Cycling Test; and the results are shown in Table 2 for resistivity on the cold cycles and in Table 3 for resistivity on the hot cycles. Item numbers correspond with the numbered yarns, above, in the example.

TABLE 2

| | Cold Side (−65° C.) Resistance in ohms/ft. after X cycles | | | | |
|---|---|---|---|---|---|
| Item | X = 0 | 10 | 20 | 30 | 40 |
| 1-Control | 7.8 | 14.4 | 17.8 | 19.9 | 20.5 |
| 1-This Invention | 6.5 | 9.4 | 11.4 | 13.3 | 15.2 |
| 2-Control | 20.1 | 65.7 | 116.2 | 270.8 | Off Scale |
| 2-This Invention | 18.9 | 28.7 | 39.2 | 45.8 | 55.2 |
| 3-Control | 7.0 | 62.2 | 120.6 | 582.6 | 958.7 |
| 3-This Invention | 4.4 | 4.9 | 5.2 | 5.6 | 6.0 |
| 4-Control | 17.5 | 920.3 | Off Scale | Off Scale | Off Scale |
| 4-This Invention | 9.5 | 31.1 | 66.6 | Off Scale | Off Scale |

TABLE 3

| | Hot Side (+150° C.) Resistance in ohms/ft. after X cycles | | | | |
|---|---|---|---|---|---|
| Item | X = 0 | 10 | 20 | 30 | 40 |
| 1-Control | 7.8 | 26.0 | 29.5 | 36.0 | 37.7 |
| 1-This Invention | 6.5 | 16.2 | 19.6 | 22.8 | 26.6 |
| 2-Control | 76.9 | 377 | 675 | 1437 | 7705 |
| 2-This Invention | 72.5 | 126 | 264 | 302 | 367 |
| 3-Control | 26.9 | 288 | 877 | 6008 | 12105 |
| 3-This Invention | 16.8 | 26.9 | 31.9 | 34.3 | 39.2 |
| 4-Control | 67.0 | 3538 | 1731 | 78897 | Off Scale |
| 4-This Invention | 36.4 | 449 | 942 | 1487 | Off Scale |

Increased resistance is taken to indicate reduced continuity of the metal coatings. In every case, plating of this invention results in yarns of lower resistance than plating applied without the treatment of this invention. That conclusion is correct for all yarns for any number of cycles.

EXAMPLE 3

In this example p-aramid yarns were treated in sulfuric acid of a variety of concentrations for a variety of times to plate fibers of the yarns with silver.

Samples of poly(p-phenylene terephthalamide) yarn of 1500 denier having 1000 filaments were contacted with sulfuric acid of the concentration and for the times specified in Table 4. The yarn samples were then rinsed in several changes of water and immersed in a dilute sodium bicarbonate solution and, again, rinsed in several changes of water. The yarn samples were then dried or kept wet for plating. Table 4 indicates drying conditions for the samples which were dried.

For plating, each yarn sample was immersed for 15 minutes in an aqueous sensitizing solution of 2.3 weight percent anhydrous stannous chloride and 5.1 weight percent hydrochloric acid (38 wt. %); and was then immersed in three changes of water to remove excess stannous ions. Each yarn sample was then immersed in an aqueous plating solution of 0.8 weight percent silver nitrate, 0.7 weight percent ammonium hydroxide solution (30 wt. %), and a wetting agent. The plating solution was kept at about 5° C.

After 15 minutes, about 0.8 weight percent formaldehyde (38 wt. %) was added to the plating bath and the bath was intermittently stirred over the course of 35 minutes.

The plated fibers were analyzed for plated silver metal to determine the amount of silver picked up during the plating process. Results are shown in Table 4. Silver pick-up was greatest for fibers contacted with acid in the 80–87% range (shown as weight percent silver on the plated fibers).

The silver plated fibers were subjected to determination of electrical resistance by clamping individual plated filaments with electrical contacts one centimeter apart and determining the resistance therebetween. Resistance for the samples of this Example are reported in Table 5 as kilo-ohms/cm.

TABLE 4

| Item | Acid Conc. (%) | Treatment Time (Sec) | Drying Conditions | Silver Wt. % |
|---|---|---|---|---|
| Control | 0 | — | — | 0 |
| 3-1 | 87 | 15 | RT/60 hrs | 23.1 |
| 3-2 | 87 | 15 | kept wet | 42.1 |
| 3-3 | 87 | 15 | 155° C./100 min | 14.5 |
| 3-4 | 85 | 40 | kept wet | 41.8 |
| 3-5 | 85 | 40 | RT/12 hrs | 14.8 |
| 3-6 | 85 | 40 | 80° C./40 min | 7.8 |
| 3-7 | 82 | 7 | kept wet | 10.7 |
| 3-8 | 82 | 15 | kept wet | 11.9 |
| 3-9 | 82 | 30 | kept wet | 13.9 |
| 3-10 | 82 | 40 | kept wet | 15.2 |
| 3-11 | 82 | 30 | RT/24 hrs | 9.9 |
| 3-12 | 80 | 30 | RT/24 hrs | 4.4 |
| 3-13 | 75 | 30 | RT/24 hrs | 0 |
| 3-14 | 65 | 30 | RT/24 hrs | 0 |

TABLE 5

| Item | Resistance in kilo-ohms/cm for Four Specimens | Average |
|---|---|---|
| Control | Off Scale | Off Scale |
| 3-1 | 0.3, 0.2, 0.3, 0.2 | 0.25 |
| 3-2 | 0.4, 0.5, 0.4, 0.4 | 0.43 |
| 3-3 | 1.5, 0.8, 0.6, 0.7 | 0.90 |
| 3-4 | 3.7, 1.3, 0.6, 0.7 | 1.58 |
| 3-5 | 1.1, 1.1, 1.6, 1.6 | 1.35 |
| 3-6 | 6.5, 2500, 2000, — | 1502 |
| 3-7 | 1.1, 1.2, 1.1, 0.8 | 1.05 |
| 3-8 | 0.9, 1.2, 0.8, 0.7 | 0.90 |
| 3-9 | 1.0, 0.8, 0.7, 0.6 | 0.78 |
| 3-10 | 1.0, 1.0, 0.9, 0.8 | 0.93 |
| 3-11 | 1.9, 1.7, 2.0, 2.0 | 1.90 |
| 3-12 | Off Scale | Off Scale |
| 3-13 | Off Scale | Off Scale |
| 3-14 | Off Scale | Off Scale |

We claim:

1. In a process for electrolessly plating aramid fibers with a durable metal coating comprising the steps of contacting the fibers to be plated with an activation solution, rinsing the fibers, and immersing the fibers in a solution of metal cations to be plated;

the improvement which comprises, (a) contacting the aramid fibers with an aqueous solution consisting of 80 to 90% sulfuric acid for 2 to 60 seconds at a temperature in the range from 10° to 100° C.; and (b) washing the acid-contacted fibers with water until substantially all of the acid is removed, before contacting the fibers to be plated with the sensitizing solution.

2. The process of claim 1 wherein there is the added step of:

(c) drying the washed fibers.

3. The process of claim 2 wherein the drying is conducted at 15°–80° C.

4. The process of claim 1 wherein the durable metal is copper.

5. The process of claim 4 wherein the sensitizing solution is a tin-palladium solution.

6. The process of claim 1 wherein the durable metal is silver.

7. The process of claim 6 wherein sensitizing solution is a stannous solution.

8. A process for plating aramid fibers with a durable metal coating comprising the steps of:

a) contacting aramid fibers with an aqueous solution consisting of 80 to 90% sulfuric acid solution for 2 to 60 seconds at a temperature in the range from 10° to 100° C.;

b) washing the acid-contacted fibers with water until substantially all of the acid is removed;

c)contacting the washed fibers with a sensitizing solution;

d) rinsing the fibers to remove nonadherent sensitizing solution; and e) immersing the rinsed fibers in an aqueous solution of metal cations to be plated.

9. The process of claim 8 wherein the metal cation to be plated is selected from the group consisting of silver, copper, nickel, and cobalt.

10. The process of claim 8 wherein there is the added step of:

drying the washed fibers after the washing of step (b).

11. The process of claim 10 wherein the drying is conducted at 15°–80° C.

* * * * *

UNITED STATES PATENT AND TRADEMARK OFFICE

CERTIFICATE OF CORRECTION

PATENT NO. : 5,302,415

DATED : APRIL 12, 1994

INVENTOR(S) : VLODEK GABARA, CHE-HSIUNG HSU AND EDWARD W. TOKARSKY

It is certified that error appears in the above-identified patent and that said Letters Patent is hereby corrected as shown below:

COL. 9, LINE 47, CHANGE "AN ACTIVATION" TO -- A SENSITIZING --.

Signed and Sealed this

Ninth Day of August, 1994

*Attest:*

*Attesting Officer*

BRUCE LEHMAN

*Commissioner of Patents and Trademarks*